United States Patent [19]

Schneider

[11] 4,055,258

[45] Oct. 25, 1977

[54] SHEET MATERIAL DE-STACKING MACHINE

[76] Inventor: Willi A. Schneider, Pfisterholzli 9, 8606 Greifensee, Zurich, Switzerland

[21] Appl. No.: 654,418

[22] Filed: Feb. 2, 1976

[30] Foreign Application Priority Data

May 9, 1975 Switzerland ..... 5968/75

[51] Int. Cl.[2] ..... B65G 59/02

[52] U.S. Cl. ..... 214/8.5 C; 214/1 BB; 214/152; 214/8.5 SS; 271/10

[58] Field of Search ..... 214/8.5 SS, 8.5 H, 8.5 C, 214/1 BB, 8.5 R, 152; 271/10

[56] References Cited

U.S. PATENT DOCUMENTS

| | | | |
|---|---|---|---|
| 3,206,042 | 9/1965 | Peterson | 214/8.5 SS |
| 3,209,931 | 10/1965 | Hawkes | 214/8.5 SS X |
| 3,608,747 | 9/1971 | Shibata et al. | 214/8.5 C X |

*Primary Examiner*—Frank E. Werner
*Attorney, Agent, or Firm*—Burns, Doane, Swecker & Mathis

[57] ABSTRACT

A sheet material de-stacking machine for removing a partial stack from a stack of sheet material includes a table top horizontally movably mounted on a frame, a drivable separating roller adjacent a front edge of the table top which is to be inserted into the stack of sheet material, and, in addition, a gripping device horizontally mounted on said frame for gripping and holding an edge of said partial stack at least during a final stage of the introduction of the table top between the partial stack and the remaining stack of sheet material. The gripping device comprises upper and lower gripping jaws which are both vertically slidably mounted in a carrier or support that is in turn movably mounted on the machine frame. A hydraulic drive means may be provided for moving the jaws towards one another, or the jaws may be set at a fixed predetermined distance. The gripping device may be arranged to move towards the stack behind the separating roller so that the latter initiates and completes the separation of the partial stack from the remaining stack. In another embodiment the roller moves behind the gripping jaws so that the separation of the partial stack is initiated by the lower gripping jaw which is introduced into the stack a predetermined distance below the upper side thereof.

7 Claims, 2 Drawing Figures

SHEET MATERIAL DE-STACKING MACHINE

BACKGROUND OF THE INVENTION

The invention relates to a sheet material de-stacking machine for removing a partial stack from a stack of sheet material, comprising a table top horizontally slidably mounted on a frame and a drivable separating roller which is arranged on a front edge of the table top to be inserted into the stack of sheets.

De-stacking machines of this kind are known and used in such a manner that the table top, with the rotating separating roller, is introduced into the stack of sheets at a predetermined height in order to separate and lift clear the upper part from the remainder of the stack and then move it away on the table top. If the stack of sheet material is tilted slightly to the front edge of the table top so that the horizontally moving separating roller first comes into contact with a corner of the stack of sheet material and if, after this coming into contact, the table top is moved slightly upwardly into the stack, the separating roller can also effect the initial separation of the partial stack to be removed from the remaining stack at the said corner and subsequently over the entire width of the stack, i.e., it is then unnecessary for the partial stack to be previously raised by hand along one edge and, for example, for an angle section to be introduced.

These known de-stacking machines generally operate in a quite satisfactory manner. However, with very smooth and/or thin sheet material it happens, particularly if the partial stack to be removed is relatively heavy, that the lowest sheet or lowest few sheets of the partial stack are displaced and/or crumpled at the end of the operation of introducing the separating roller and table top into the stack.

It is therefore an object of the invention to provide a de-stacking machine of the type set forth with means capable of preventing this phenomenon.

SUMMARY OF THE INVENTION

According to the invention the de-stacking machine includes a gripping device which is horizontally movably mounted on the frame, for gripping an edge of a removed partial stack at least during a final stage of the introduction of the table top between the partial stack and remaining stack of sheet material.

The gripping device can be arranged so that initially it moves — horizontally with the table top — behind the separating roller, in the sense that first of all the separating roller comes into contact with the stack of sheet material and, as explained above, can effect the initial separation, the gripping device then gripping the raised edge of the partial stack and subsequently coming to a standstill during the further movement of the table top.

However, in certain applications it may also be advantageous for the gripping device to move initially in front of the separating roller, the partial stack being raised in the area of one corner first by the gripping device before the separating roller moves in between the partial stack and remainder of the stack and completes the separation. Partial stacks of very precisely predetermined thicknesses can be removed with gripping devices operated in this manner.

DESCRIPTION OF THE PREFERRED EMBODIMENTS

Figure 1:
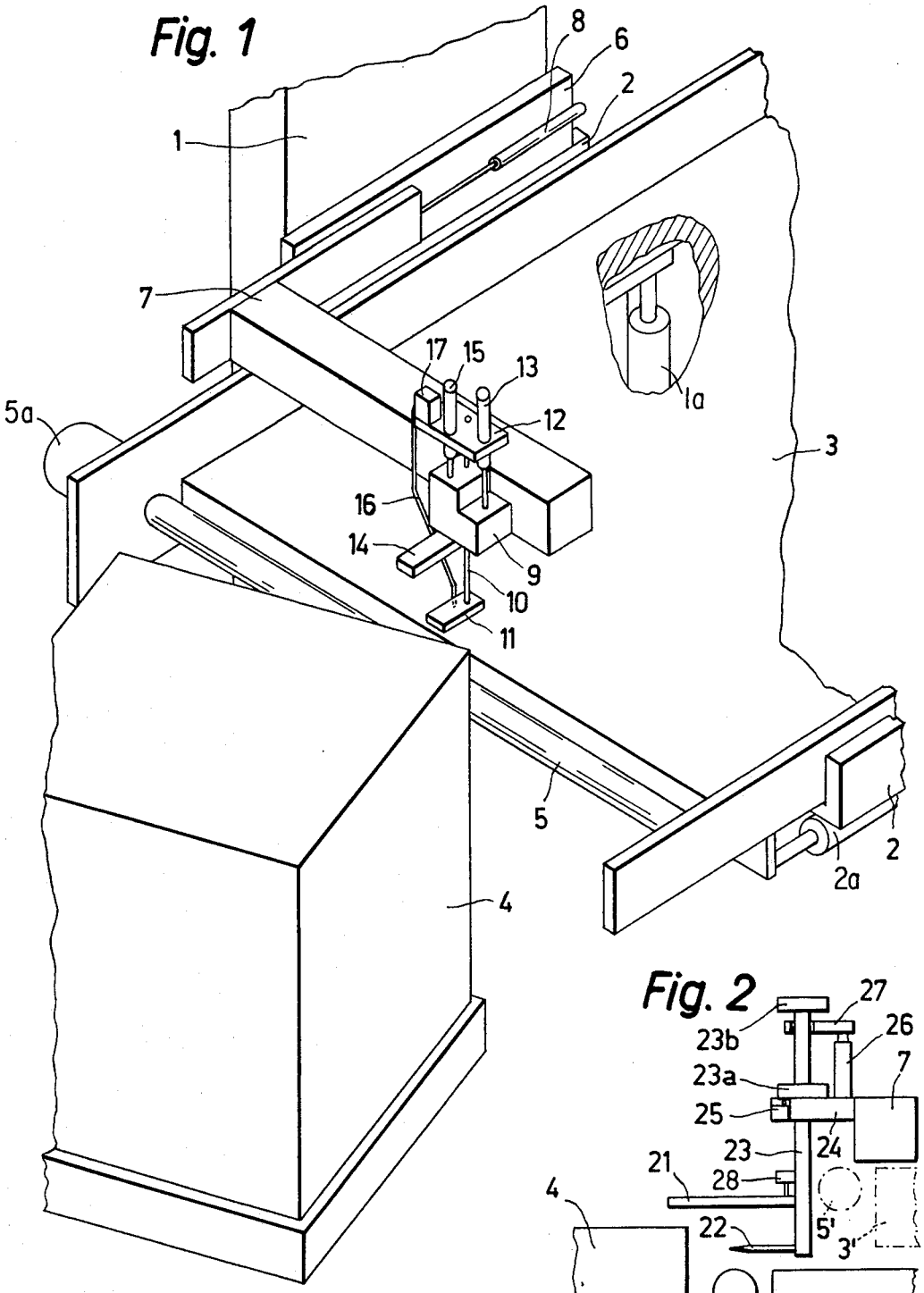
FIG. 1 is a diagrammatic partial view, in perspective, of a de-stacking machine according to the invention

The de-stacking machine illustrated in FIG. 1 comprises a frame with a support 1 standing on the floor and a slide 2 vertically adjustably mounted thereon. Horizontally slidably mounted on the slide 2 is a table top 3, preferably a so-called "air table," on which a partial stack of sheets can be easily slidably supported by means of an air cushion. Hydraulic drive means **2*a* are provided on the slide 2 for the horizontal displacement or feed of the table top 3. Arranged on the left of and next to the table top 3 on the floor is a stack 4 of sheet material from which a partial stack is to be removed by means of the table top. A horizontal separating roller 5, which is parallel to the left edge of the table top 3 and drivable by a driving means 5*a*, is arranged on this front edge, i.e., left hand edge in the drawing, of the table top 3 which is to be introduced into the stack 4** of sheets.

A carrier 7 for supporting a gripping device is horizontally slidably mounted on a second slide 6 which is vertically slidably mounted on the support 1 and connected to the first slide 2. For the horizontal sliding movement of the gripping device carrier 7 relative to the slide 6, a hydraulic cylinder 8 is provided on the latter. Attached to the carrier 7 is a block 9 in which a rod 10 is vertically slidably guided, the lower end of said rod supporting a lower gripping jaw 11 and its upper end supporting a plate 12. The plate 12 and therefore the lower jaw 11 can be raised and lowered relative to the block 9 by means of a hydraulic cylinder 13. An upper jaw 14 can be raised and lowered relative to the plate 12 by means of a hydraulic cylinder 15 for opening and closing the grippers.

The driving means associated with the various described components are operated as follows by an automatic control device in each case to remove a partial stack from the stack 4 of sheets. First the table top 3 for removing a partial stack of predetermined thickness is set at a predetermined height below the upper end of the stack 4 by vertical sliding of the slides 2 and 6 along the support 1. For this purpose the upper end of the stack 4 can for example be scanned by a photoelectric cell control system (not shown) which is raised and lowered with the table top. Then the table top 3 is horizontally displaced along the slide 2 until the roller 5 is positioned slightly in front of the corner of the stack 4 facing the table top 3, which can be monitored by a second photoelectric cell control system (not shown), and then the table top is moved further forward while at the same time being slightly raised so that the driven separating roller 5 moves obliquely upwardly into the stack 4.

In this connection the gripping device carrier 7 and therefore the gripping jaws 11 and 14 are moved forward with the table top by the hydraulic cylinder 8, the lower jaw 11 moving a short distance behind the roller 5 (in order to prevent it from coming into contact with the stack 4 before the roller 5 moves into same). The partial stack removed from the roller 5 is taken up between the jaws 11 and 14 and finally actuates a detector means including a control arm 16 of a controller means 17 attached to the plate 12. The oil supply to the hydraulic cylinder 8 is switched off by this control switch so that the jaws 11 and 14 are stationary during further forward movement of the table top 3, and the oil supply to the cylinder 15 is switched on to lower the upper jaw 14 towards the lower jaw 11 and clamp the edge of the removed partial stack.

The cylinder 13 is only used to enable the entire gripping device assembly 10 – 16 to be raised after the partial stack has been deposited on the table top in order that the partial stack may then be moved back with the table top under the gripping device assembly, e.g., to a cutting or punching machine. Alternatively the cylinder could be omitted and the plate 12 rigidly connected to the block 9 if the slide 6 can be independently raised relative to the table top slide 3.

Figure 2:
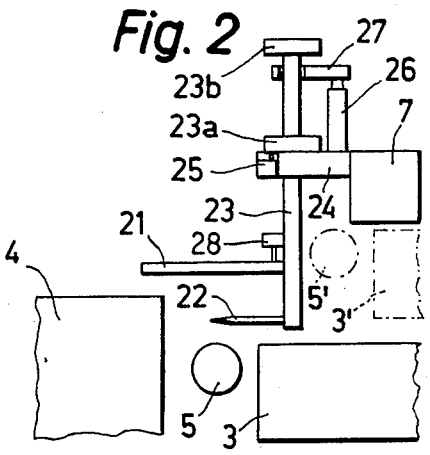
FIG. 2 is a diagrammatic side view of a detail modification.

A gripping device can also be arranged slightly differently on the carrier 7, as diagrammatically illustrated in FIG. 2, and operated differently in order that it may take over another function in addition to the gripping of the removed partial stack during forward movement of the table.

The gripping device shown in FIG. 2 consists of an upper jaw 21 and a lower jaw 22 which are attached, at an accurately adjustable distance from one another, to a rod 23 which is vertically slidably guided in a block 24 fixed to the carrier 7. The upper jaw 21 is substantially longer than the lower jaw 22, and the front end of the latter comprises a sharp point, combined if desired with a horizontal edge, with which it can penetrate into the stack 4. In the inoperative position the rod 23 is supported with a flange 23*a* on the upper side of the block 24 and therefore maintains a control switch 25 in the block 24 in the closed position. By way of an actuating member 27 a hydraulic cylinder 26 attached to the block 24 engages on a second flange 23*b* on the rod 23 in order to lift the gripping device 21, 22, 23.

The gripping device shown in FIG. 2 is operated in the following manner, again by an automatic control device.

First the table top 3 is set at approximately the correct height relative to the upper end of the stack 4 and then moved horizontally forward until the roller 5 is located sightly in front of the corner of the stack 4, as described with reference to FIG. 1. In this connection the gripping device support 7 and the gripping device are also moved with the table top, in such a position relative to the latter that at least the upper jaw 21 projects forward slightly beyond the roller 5, as shown in FIG. 2. If the roller 5 is now located slightly in front of the stack 4, then the upper jaw 21 extends slightly above the top side of the stack 4, as shown in FIG. 2.

Then the table top and gripping device support 7 are lowered slightly (by means of slides 2 and 6) until the jaw 21 rests on the top side of the stack 4 and the control switch 25 opens. The lowering movement is stopped through the opening of the switch and, with the table feed stationary, the hydraulic drive 8 of the gripping device support 7 is switched on. The gripping jaw 22 moves into the stack 4 under the upper end thereof at a distance precisely determined by the (variable) distance between the two jaws and thus grips a partial stack of precisely predetermined thickness to be removed. Since, when the jaw 22 moves into the stack 4, this partial stack is subjected to pressure by the constant own weight of the gripping device, i.e., the parts 21, 22, 23, the predetermined thickness corresponds also in practice to a predetermined number of sheets in the partial stack.

After a predetermined feed or after the partial stack gripped by the jaws has actuated a switch in a similar manner to FIG. 1, the gripping device feed 8 is switched off, and the table top 3 and gripping device support 7 are subsequently raised in order to slightly lift the gripping device and separated partial stack in the vicinity of the corner of the stack. Then, with the gripping device stationary, the horizontal table feed is switched on so that the roller 5 moves in between the partial stack and the remainder of the stack, removing the partial stack across its entire width. In this operation the hydraulic driving means 1*a* provided for raising and lowering the slide 2 constitute a vertical driving means for the gripping device 21, 22, 23 (which is raised, by slide 6 and carrier 7, together with the table top 3).

Similar to the cylinder 13 in FIG. 1, the hyrdaulic cylinder 26 can be used to lift the gripping device after depositing of the partial stack is completed, so that the partial stack can be moved under and past them.

When removing relatively thin (approximately 2 cm thick) partial stacks, it is usually unnecessary for the gripping jaws to be pressed specially against one another to grip the edge of the partial stack. However, if desired, additional means 28 can obviously be provided also in the embodiment shown in FIG. 2 for the mutual pressing together of the jaws during gripping of the partial stack.

For certain uses where high working speed is desired, it may be advantageous for the table top to be supported at a constant height (corresponding to the working height of following cutting machines or the like) and for a controllable lifting device to be associated with the stack 4 for adjusting the relative height. In this connection only the approximate height adjustment (e.g. controlled by a photoelectric cell system) is then advantageously, but not necessarily, effected by the stack, whereas the lowering of the upper jaw 21 onto the upper end of the stack 4 can be effected by an additional height adjustment of the gripping device support slide 6 (with the table slide 2 stationary) until opening of the switch 25. Also, after the subsequent forward movement of the gripping jaws into the stack, only the gripping device is advantgeously lifted (by the gripper support slide 6) to raise the separated partial stack. In order that the table top may then be introduced between the partial stack and remainder of the stack, although it is not raised with the gripping jaws, it must be from the beginning at a higher level relative to the gripping device than is indicated in FIG. 2, and therefore also completely behind the gripping jaws, for example as shown by the chain-dotted lines at 3′ and 5′ in FIG. 2. In this case the hydraulic lifting device (not shown) for raising and lowering the slide 6 relative to the slide 2 constitutes the vertical drive means for the gripping device.

What I claim is:

1. A sheet material de-stacking machine for removing a partial stack from a stack of sheet material, comprising a machine frame, a table top which is horizontally movably mounted on said frame, a drivable separating roller which is arranged adjacent a front edge of said table top that is to be inserted into said stack of sheet material, a gripping device horizontally movably mounted on said frame and including upper and lower jaws for gripping an edge of said partial stack, and means for moving said gripping device horizontally against said stack, for gripping an edge of said partial stack with said gripping jaws, and for then holding said gripping device with the gripped edge stationary during travel of said table top between the partial stack and remaining stack of sheet material, to substantially avoid horizontal movement of the sheets of said partial stack during insertion of the table top.

2. A de-stacking machine as claimed in claim 1 and further comprising gripping device carrier which is mounted on said frame and in which said gripping jaws are mounted for common vertical movement.

3. A sheet material de-stacking machine for removing a partial stack from a stack of sheet material, comprising a machine frame, a table top which is horizontally movably mounted on said frame, a drivable separating roller which is arranged adjacent a front edge of said table top that is to be inserted into said stack of sheet material, a gripping device horizontally movably mounted on said frame and including upper and lower jaws for gripping an edge of said partial stack at least during a final stage of the introduction of said table top between the partial stack and remaining stack of sheet material, first driving means for the horizontal forward movement of said gripping device together with said table top with at least said lower jaw positioned behind said separating roller, second driving means for moving said jaws towards one another, and a detector means which is movable with said gripping device for determining the point of contact of said gripping device with the edge of said partial stack, switching off said first driving means and switching on said second driving means.

4. A sheet material de-stacking machine for removing a partial stack from a stack of sheet material, comprising a machine frame, a table top which is horizontally movably mounted on said frame, a drivable separating roller which is arranged adjacent a front edge of said table top that is to be inserted into said stack of sheet material, a gripping device horizontally movably mounted on said frame and including upper and lower jaws for gripping an edge of said partial stack at least during a final stage of the introduction of said table top between the partial stack and remaining stack of sheet material, wherein said gripping jaws can be set at a predetermined distance from one another, said lower gripping jaw having a sharp point for introduction into the stack of sheet material and said upper gripping jaw being longer than said lower gripping jaw, and further comprising horizontal driving means and veritcal driving means for said gripping jaws, and said machine also including horizontal feed means for said table top, said horizontal driving means being adapted to first move said gripping jaws forward with said table top and subsequently, with the table top stationary and after relative height adjustment between said gripping jaws and said stack such that said upper jaw rests on the upper side of the stack, to move only the gripping jaws further forward, said vertical driving means being adapted to subsequently raise said gripping jaws relative to said stack of sheet material before said table top feed means are switched on again with said horizontal driving means switched off.

5. A de-stacking machine as claimed in claim 4 and further comprising an additional driving means for pressing said gripping jaws together after said further forward movement thereof.

6. A method of removing a plurality of sheets from a stack of sheets comprising the steps of providing a de-stacking device which includes a table top, a roller positioned forwardly of said table top and gripping means comprising upper and lower jaws positioned above said table top, moving the device horizontally forwardly and upwardly towards a corner of said stack of sheets so that said roller enters the stack and divides a plurality of sheets from the main stack to form a secondary stack, moving said upper and lower jaws together to clamp an edge of said secondary stack, holding said upper and lower jaws stationary, moving said table top relative to said jaws between said secondary stack and said main stack, causing relative movement between said gripping jaws and said table top to position said secondary stack on the table top and moving the upper and lower jaws apart to release the secondary stack.

7. A method of removing a plurality of sheets from a stack of sheets comprising the steps of providing a de-stacking device which includes a table top, a roller positioned forwardly of said table top and gripping means comprising upper and lower jaws positioned forwardly of said roller and table top, moving said jaws forwardly towards a corner of said stack of sheets so that said lower jaw enters the stack and divides a plurality of sheets from the main stack to form a secondary stack an edge of which is held between said jaws, raising said jaws with said edge of said secondary stack, holding said jaws stationary, and moving the roller and table top forwardly between the main stack and secondary stack.

* * * * *